US006581725B2

(12) United States Patent
Choate

(10) Patent No.: US 6,581,725 B2
(45) Date of Patent: Jun. 24, 2003

(54) METHOD TO REDUCE HORIZONTAL LIFELINE TENSION AND EXTENSION DURING FALL ARREST

(76) Inventor: Gary E. Choate, 1675 Carr St., #101N, Lakewood, CO (US) 80215

( * ) Notice: Subject to any disclaimer, the term of this patent is extended or adjusted under 35 U.S.C. 154(b) by 0 days.

(21) Appl. No.: 09/944,279

(22) Filed: Aug. 30, 2001

(65) Prior Publication Data

US 2002/0046902 A1 Apr. 25, 2002

Related U.S. Application Data

(60) Provisional application No. 60/229,719, filed on Aug. 31, 2000, now abandoned.

(51) Int. Cl.[7] ..... A62B 35/00
(52) U.S. Cl. ..... 182/3; 182/36

(58) Field of Search ..... 182/3, 36

(56) References Cited

U.S. PATENT DOCUMENTS 5,332,071 A * 7/1994 Duncan ..... 188/371
5,458,218 A * 10/1995 Olson ..... 182/18

* cited by examiner

*Primary Examiner*—Alvin Chin-Shue
(74) *Attorney, Agent, or Firm*—Ramon L. Pizarro

(57) ABSTRACT

A method for creating a horizontal lifeline between a pair of end anchorages. The method includes providing a section of line having a modulus of elasticity, providing an energy absorbing shock absorber having a deployment load, connecting the section of line and the shock absorber to one another, between the end anchorages, and tuning the section of line by tensioning the section of line to a load that is approximately equal to the deployment load.

1 Claim, 5 Drawing Sheets

Figure 3:
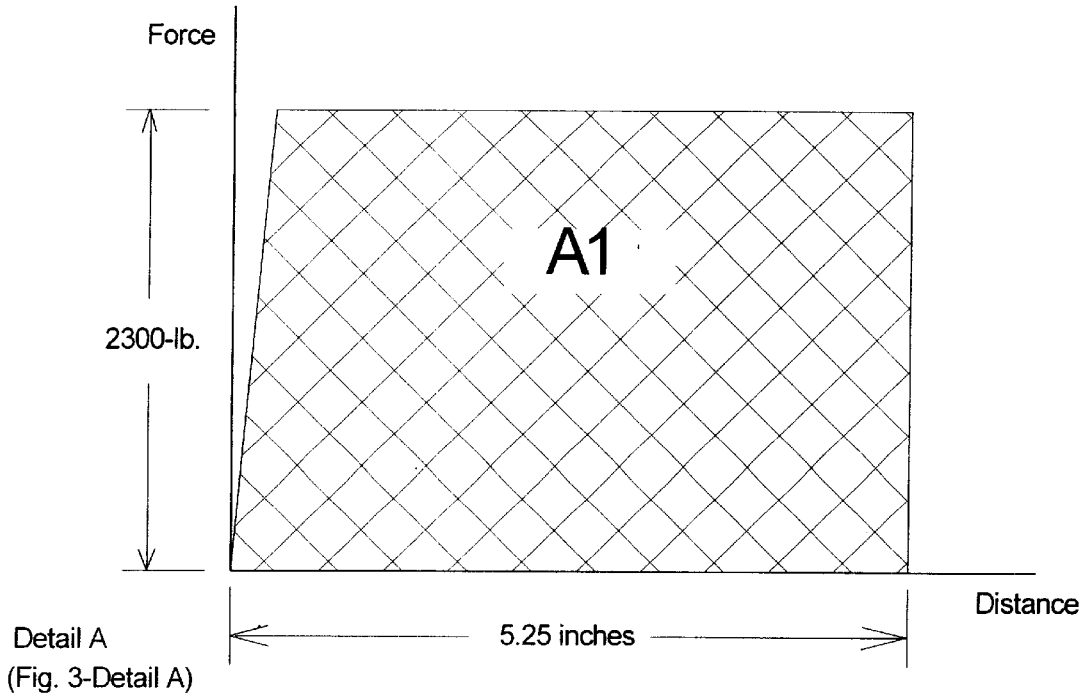
Figure 3:
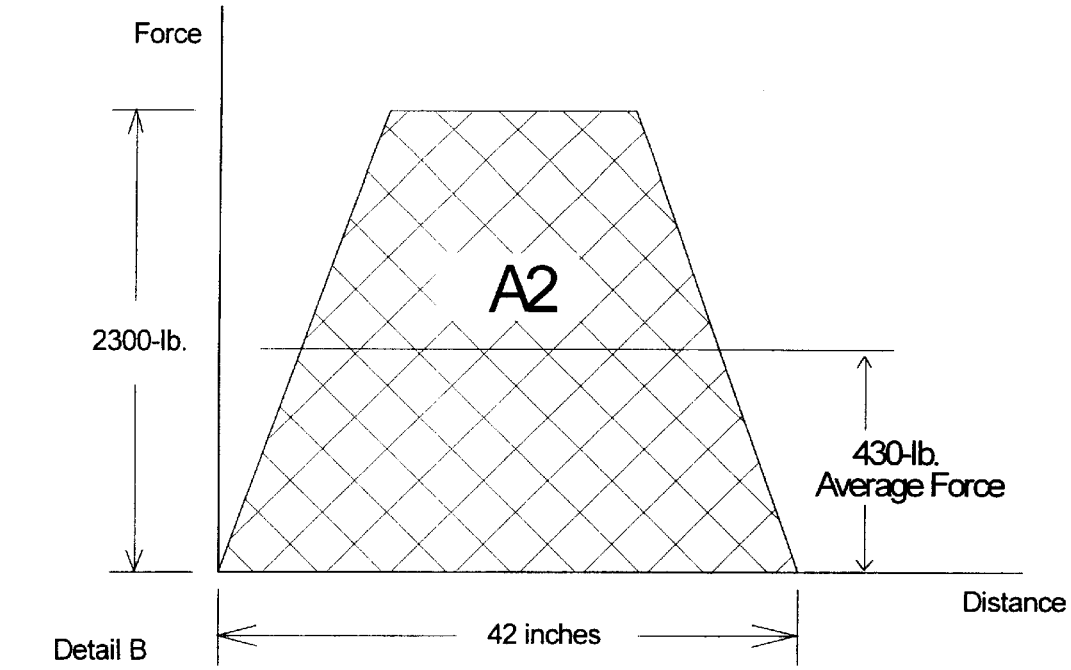

Detail A
(Fig. 3-Detail A)

Detail B
(Fig. 3-Detail B)

METHOD TO REDUCE HORIZONTAL LIFELINE TENSION AND EXTENSION DURING FALL ARREST

REFERENCE TO RELATED APPLICATIONS

This application claims the benefit of my provisional application having Ser. No. 60/229,719, filed Aug. 31, 2000, now abandoned.

BACKGROUND OF THE INVENTION (a) Field of the Invention

The present invention relates to a method for reducing line tension and extension in horizontal lifelines used for fall arrest anchorages. Additionally, this invention relates to a method that can be used to determine total energy capacity of a horizontal lifeline system and the safety factors that can be used for design. Additionally, this invention relates to the method used to predict line tension and extension as input loads and span lengths change.

(b) Discussion of Known Art

Horizontal lifelines are sections of cable or other elongated, usually flexible, members that are used as an attachment structure for tethers that are in turn attached to safety harnesses and the like. The safety harness type device is a device worn by an individual working at an area where the risk of falling is a significant risk.

Horizontal lifeline systems are currently used in many applications for fall arrest anchorages in the manufacturing, processing, transportation, and construction and other industries. These horizontal lifelines may be installed as permanent systems for such applications as pipe racks, loading docks, and hangar facilities; portable systems for such applications as construction; and temporary systems for such applications as maintenance or rescue.

The types of line used in these systems may be steel wire rope, synthetic rope, or flat synthetic webbing. A typical installation for a horizontal lifeline system is to suspend a horizontal cable between two anchorages, typically from 20-ft. to 200-ft. apart. The anchorage elevation is typically 5-ft. above the walking/working surface as is required by geometry restrictions imposed by OSHA regulations. When suspended, a horizontal lifeline must be pre-tensioned to keep the line from having too much sag in the center of the span. The angle that the cable makes at each anchorage, measured below horizontal, is referred to as the "Sag Angle". When a horizontal lifeline cable is loaded in the center of a span it imposes a tension in the horizontal lifeline. This tension is proportional to the angle of sag. The lower the sag angle, the higher the ratio between the line tension and the load in the center of the span. This ratio is referred to as the load amplification factor. For example, at 0.5° of sag the load amplification factor is approximately 50 to 1. At 7° of sag the load amplification is approximately 4 to 1. Hence it can be seen that the load amplification increases exponentially with decreases in sag angle. For this reason, most horizontal lifeline installations use only enough pre-tension, or tension load in the lifeline, so that the cable can maintain a sag in the 7° range when loaded. This amount of pre-tension is indicated by the manufacturers and is usually in the 175 to 300-lb. Range, depending on span length and cable weight.

Additionally, some manufacturers use energy absorbers in the horizontal lifeline systems. These energy absorbers increase the hysterisis of the system to decrease rebound, absorb some energy, and elongate the horizontal lifeline upon loading to decrease the load amplification. All manufacturers, however, do not pre-tension their lifelines beyond that level required for proper load amplification during a fall. None set pretension requirements above the 300-lb. level.

SUMMARY

The present invention generally relates to a new technology referred to as "Cable Tuning" that can be used to increase the safety of workers using horizontal lifelines. Historically, horizontal lifeline installations were limited by 2 factors acceptable line tension and acceptable total fall distances. Usually to decrease line tension one had to allow a longer fall distance or (more time) to absorb the fall energy. Conversely, if one was limited by fall distance, it required higher allowable line tensions to absorb the energy in a shorter fall distance (or in less time). It has been discovered that by "Cable Tuning," using high pre-tension or pre-tension levels far above those necessary for proper sag angle, and combining this with the use of a shock absorber to controllably elongate the horizontal lifeline at a high pre-tension, that line tension and fall distance could both be reduced and, counter to conventional wisdom, both be done at the same time.

The method included analysis of the following components:

a. a shock absorber with integral line tension indicator;

b. a horizontal lifeline cable;

c. end anchorages;

d. a line tensioner;

e. a method to determine input energy;

f. a method to determine shock absorber energy capacity;

g. a method to determine shock absorbing lanyard energy capacity;

h. a method to determine horizontal lifeline energy capacity;

i. a method to determine horizontal lifeline strain under tension.

As can be understood from the above items, another aspect the invention relates to a method for explaining quantitatively how horizontal lifeline rope absorbs energy and a method for calculating its' total energy capacity.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

Figure 1:
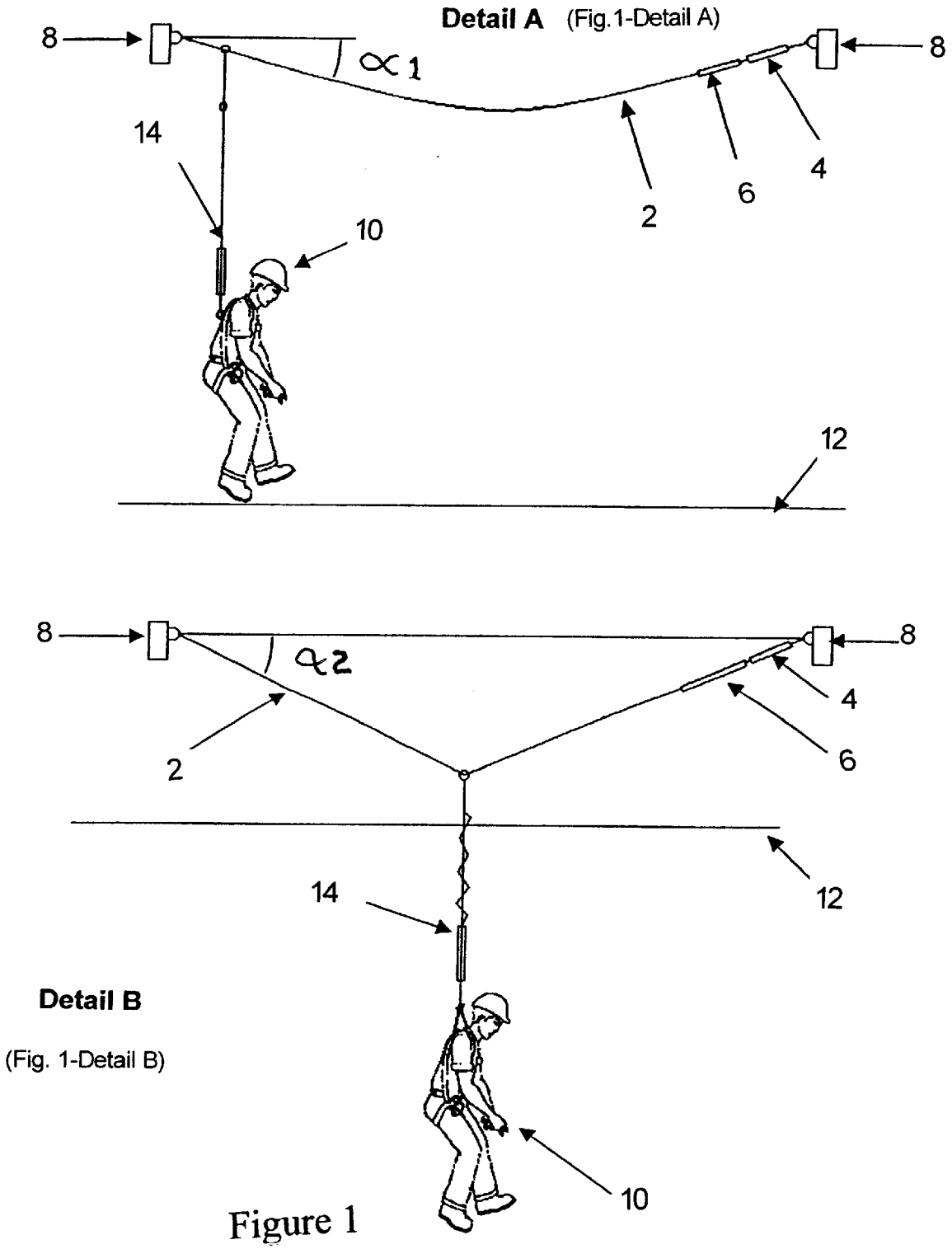

The accompanying drawings illustrate preferred embodiments of the present invention according to the best mode presently devised for making and using the instant invention, and in which:

FIG. 1 contains 2 details:

Detail A is a drawing of a typical horizontal lifeline system.

Detail B is a drawing of a typical HLL system after deployment.

Figure 2:
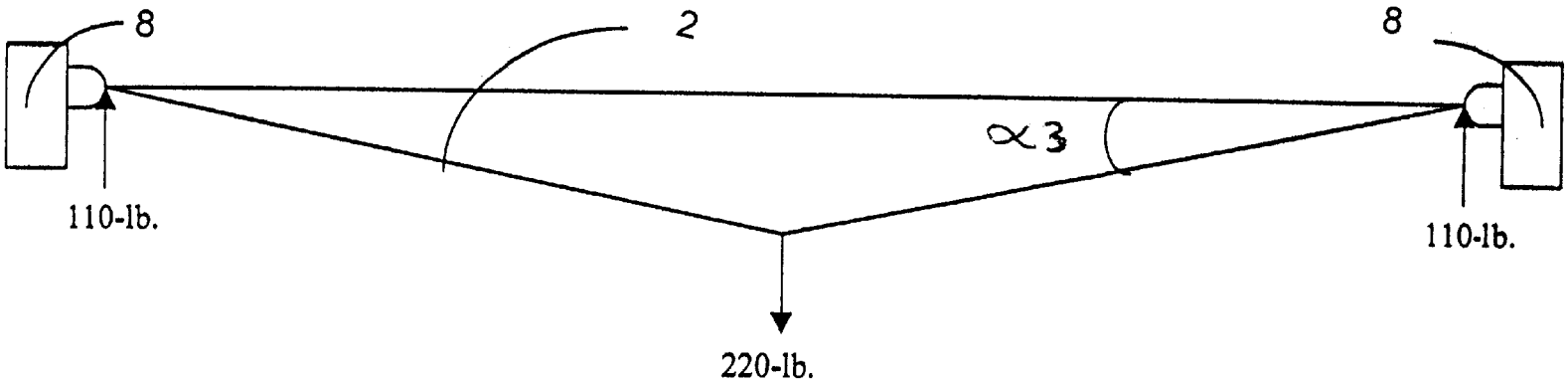

FIG. 2 is a HLL force balance diagram.

FIG. 3 contains 2 details:

Detail A shows an HLL shock absorber stress-strain curve.

Detail B shows a shock absorbing lanyard stress-strain curve.

Figure 4:
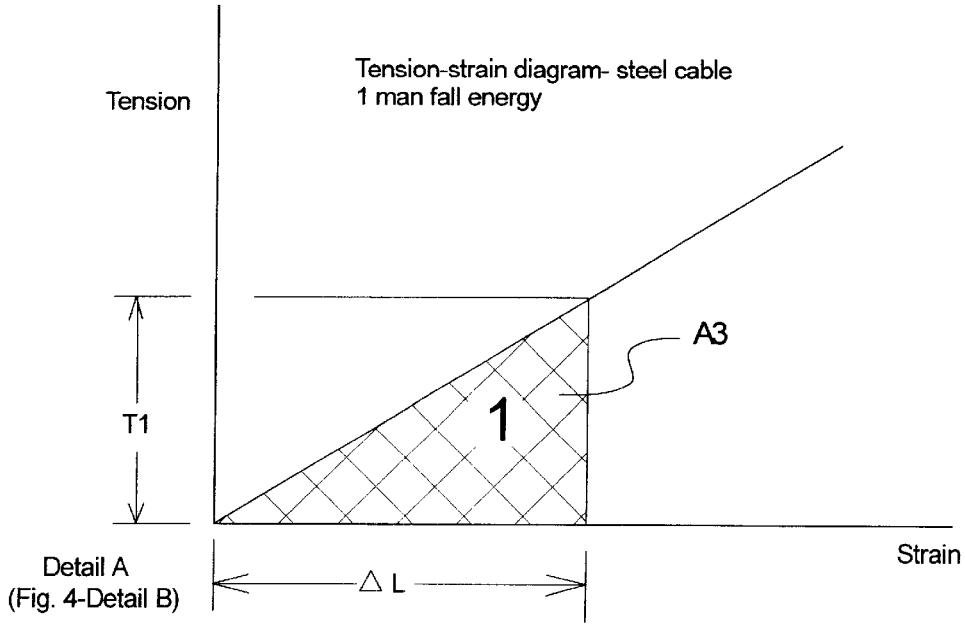
Figure 4:
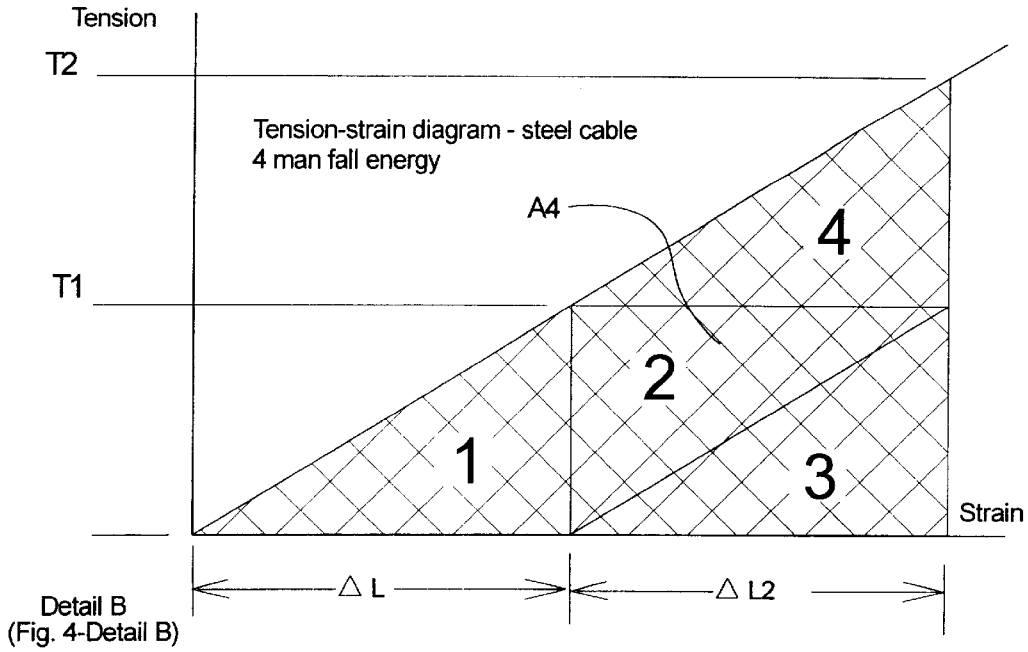

FIG. 4 contains 2 details:

Detail A shows a tension-strain diagram for a horizontal lifeline steel cable with 1 man fall energy.

Detail B shows a tension-strain diagram for a horizontal lifeline steel cable with 4 men fall energy.

Figure 5:
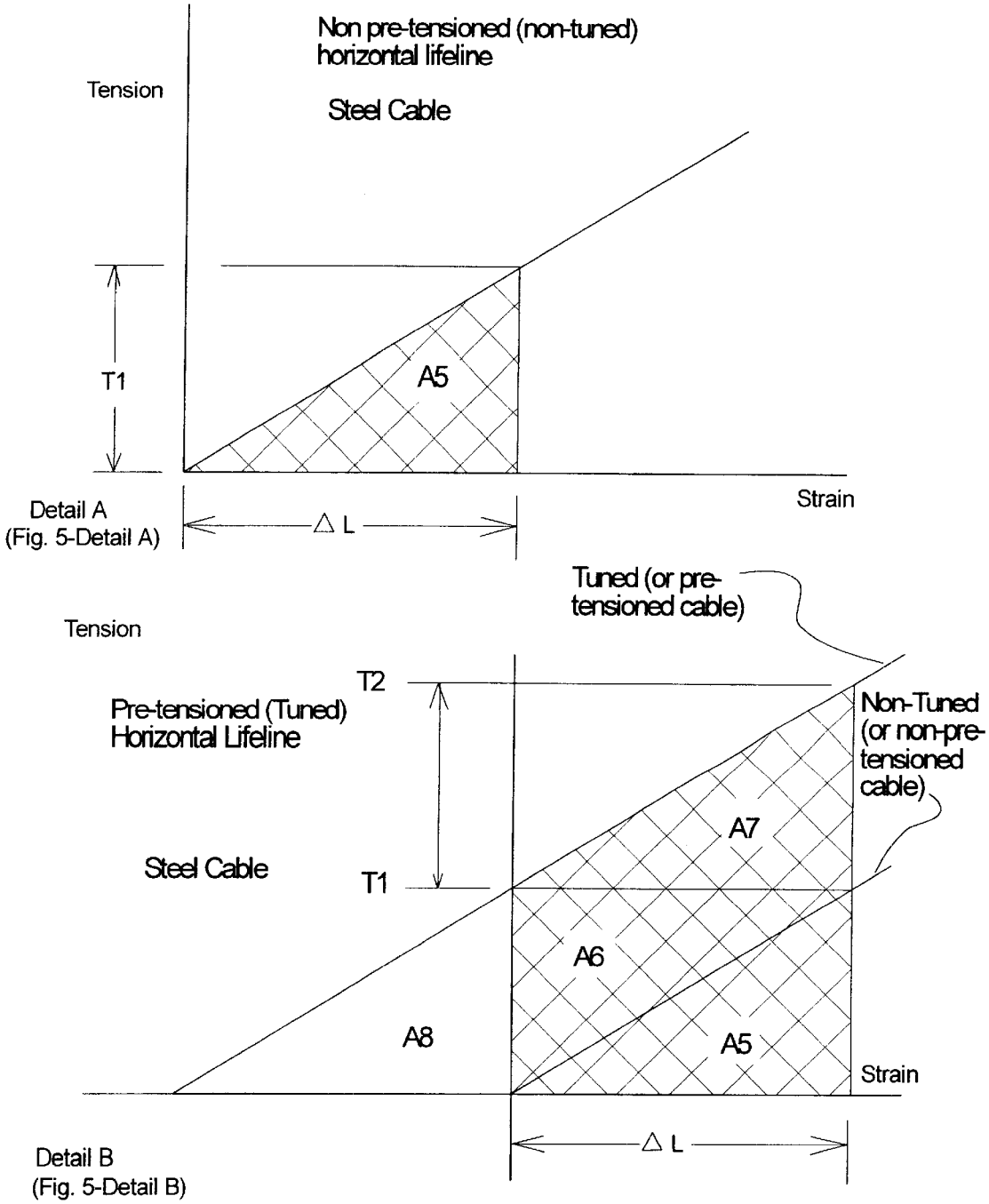

FIG. 5 contains 2 details:

Detail A shows a tension-strain diagram for a non-pre-tensioned steel cable.

Detail B shows a tension-strain diagram for a pre-tensioned (Tuned) steel cable.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

FIG. 1 illustrates a horizontal lifeline arrangement and geometry used according to the preferred embodiment of this invention. In Detail A of FIG. 1, the horizontal lifeline cable (2) is inline with the line tensioner (4), and the horizontal lifeline shock absorber (6). The horizontal lifeline system is supported by end anchorages (8). The worker (10) is shown on the walking/working surface (12). In Detail B of FIG. 1, the horizontal lifeline (2) is shown extended, as it would be after a fall has occurred. The initial sag angle $\alpha_1$ has increased to the final sag angle $\alpha_2$. The total fall distance required to stop and suspend the worker (10) is shown by (TFD). This is the distance that the worker (10) has fallen from the walking/working surface (12) to the lowest point in the fall cycle. The worker (10) is connected to the horizontal lifeline using a shock absorbing vertical lanyard (14) or possibly a self-retracting lanyard. The energy that the worker has imparted into the system is calculated as follows.

A Method to Determine Input Energy

From engineering principles it is known that $$\text{Energy}=\text{Force times Distance}$$

Or $$E=F\times D$$

Force equals the workers weight, so F=W.

Distance equals the worker fall height, so D=H.

Therefore, $$E_{IN}W\times D$$

or the input energy into the system is equal to the workers' weight times the distance the worker falls.

From this analysis it is evident that the amount of input energy going into the horizontal lifeline fall arrest system can be reduced either by reducing weight or reducing the distance that the worker falls. The weight of a typical worker is considered to be around 220-lb. for most calculations. When a 220-lb. person falls his mass will continue to accelerate until the upward pull due to the horizontal lifeline tension is equal to the 220-lb. falling weight. The farther he is allowed to fall, the more energy he has introduced into the system. Thus, the sooner a 220-lb. upward force can be achieved in a fall arrest cycle the lower will be the input energy into the system. A 220-lb. upward force will be achieved when the vertical component of the line tension imparts a 110-lb. load to each end anchorage (see FIG. 2).

For analysis assume a 20-ft. span and a shock absorber that deploys at 1800-lb. The following is a calculation of the sag angle at maximum acceleration $\alpha_3$:

$$Y=R\times\text{Sin}\ \alpha_3$$

$$\text{Sin}\ \alpha_3=Y/R$$

$$\alpha_3=\text{Sin}^{-1}\ (Y/R)$$

$$\alpha_3=\text{Sin}^{-1}\ (110/1800)=0.0611$$

$$\alpha_3=3.5°$$

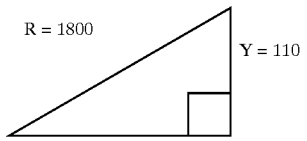

A 3.5° drop angle on a 20-ft. span means a drop elevation of:

$$Y/X=\text{Tan}\ \alpha_3$$

$$Y=X\ \text{Tan}\ \alpha_3$$

$$Y=10'\ \text{Tan}\ 3.5°$$

$$Y=0.61\text{-ft.}$$

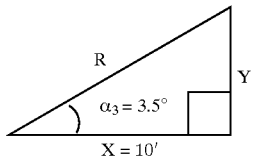

Therefore before 0.61-ft. of drop height the falling person is accelerating and gaining energy, but after the 0.61-ft. fall height the falling person is de-accelerating but still gaining some energy until an equilibrium is reached and the falling weight stops. It is evident from this analysis that the higher the initial line tension used in an installation (so long as a high tension shock absorber is used to allow the horizontal lifeline to elongate under load), the lower the input energy will be. This is because the falling weight is resisted and de-accelerated sooner in the fall cycle allowing less fall height and energy to enter into the system, thereby reducing the maximum velocity achieved by the falling object. By reducing the maximum velocity achieved by the falling object early in the fall cycle, the final line, or lifeline, tension is reduced. This approach runs counter to the theory endorsed by know or conventional lifeline technology, which states that final line tension is determined by initial sag angle, and that the greater the sag angle, the lower the final line tension. The disclosed invention takes advantage of the discovery that final line tension is predominantly determined by the momentum gained by the falling object, and not the inclusion of a large sag angle in the resting line.

Conservation of momentum dictates that the mass of an object times the peak velocity achieved during a fall is equal to the deceleration force to be applied times the duration of the deceleration period. In other words, M×V=F×t, the deceleration force is the force applied through line tension, and mass is the mass of the falling person. Rearranging this equation one arrives at the conclusion that line tension is equal to M×V/t. In other words, line tension is directly proportional to the time that the cable is allowed to stretch while absorbing energy (decelerating the falling person). Since the mass of the falling person is a constant, the only variable that can affect line tension is maximum velocity and time. Time is a function of cable length, the longer the cable, the more time needed to absorb a given amount of energy. Therefore, for a given cable length, it has been discovered that reduction of velocity by commencing the deceleration process early in the fall, which can be achieved by resisting the falling weight early in the fall cycle by eliminating or minimizing sag angle through pre-tensioning of the line or lifeline, and thus reacting the force on the line at an early stage by commencing the dampening or hysterisis as soon as possible in the fall cycle. This though, cannot be achieved on horizontal lifeline systems that do not use integral shock absorbers to elongate the life line because the cable cannot stretch far enough to increase the final sag angle ($\alpha_2$) enough to drop the low sag angle load amplification.

A Method to Determine Shock Absorber Energy Capacity

There are 3 energy absorbers in a horizontal lifeline system. They are:

1. The horizontal lifeline cable (2)
2. The horizontal lifeline shock absorber (6)
3. The shock absorbing lanyard (14)

(All labeled per FIG. 1.)

The energy capacity of the horizontal lifeline shock absorber (Item 6 in FIG. 1) is determined by the extension force and the extension distance. The extension force is 2300-lb. and the extension distance is 5.25". The energy capacity then is $$E=F\times D$$

Or $$E=2300\text{-lb.}\times 5.25''\times 1\text{-ft.}/12''=1006.25\text{ ft-lb.}$$

See FIG. 3, Detail A.

A Method to Determine Shock Absorbing Lanyard Energy Capacity

The energy capacity of the webbing type shock-absorbing lanyard used to attach the worker to the horizontal lifeline cable is determined by the force required to cause it to ripout (deploy) times the distance it rips out. If the shock absorber rips out at 900-lb. and has a maximum elongation of 42" then the energy capacity is:

$$E=F\times D$$

Or $$E=900\text{-lb.}\times 42''\times 1\text{-ft.}/12''=3150\text{ ft-lb.}$$

of total energy capacity.

See FIG. 3, Detail B.

A Method to Determine Horizontal Lifeline Energy Capacity

In the previous 2 examples the energy capacities of the inline horizontal lifeline shock absorber and the shock-absorbing lanyard were both determined by the simple calculation of force times distance because the force is constant through the distance it acts. Additionally, both of these shock absorbers are all mechanical hysterisis devices, meaning that they convert all of the input energy into heat and mechanical deformation and return none to the system. The HLL cable on the other hand has a variable input force that increases linearly with strain and has almost no hysterisis and returns virtually all of the energy it absorbs back to the system. The stress-strain curve for the energy absorbed by the HLL cable is shown in FIG. 4. Detail A shows the tension-strain curve for a cable starting to be strained with no initial line tension. Since the energy absorbed is equal to force times distance, the energy is equal to the average force (the peak force divided by 2) times the distance that the cable strains, or:

$$\text{Energy } E=\tfrac{1}{2}\times T\times \Delta L.$$

See Detail A of FIG. 4.

Here note that the energy absorbed is proportional to the area $A_3$ shown in Detail A of FIG. 4.

This means that a fall of say one person with a fall arrest energy proportional to area $A_3$ will create a line tension $T_1$ and a cable strain of $\Delta L$.

When additional people are added to an HLL system and all fall at the same time the energy input increases proportionally to area $A_3$. For example, if 4 people fall on the line at the same time the input energy would be proportional to area $A_4$ (the sum of the small triangles 1 through 4) in Detail B of FIG. 4. Note what this does to line tension and strain. Increasing the input energy (or area) by 4 doubles the line tension and doubles the strain. In other words, horizontal lifeline line tension increases proportionally to the square root of the input energy. Therefore a 2-man drop increase line tension by a factor of $\sqrt{2}$ or 1.4. A 3 man drop increases line tension by a factor of $\sqrt{3}$ or 1.7 and a 4 man drop increases line tension by a factor of $\sqrt{4}$ or 2. This has been found to be true in both calculation and testing. This is what makes horizontal lifelines inherently safe. When the force applied to a rigid anchorage is doubled it doubles the stress. But when the force on a shock absorbing anchorage like a horizontal lifeline is doubled it increases the stress by the square root of 2 or 1.4. Likewise an increase in vertical force by a factor of 9 would increase line tension by only a factor of 3, not a factor of 9 as would occur in a non-shock absorbing anchorage.

Cable Tuning

Once it was determined how a cable absorbs energy, it was realized that HLL cable could be tuned to cause it to absorb energy at a higher rate. In Detail A of FIG. 5 it can be seen that a line tension of $T_1$ creates a strain $\Delta L$ and absorbs energy proportional to area $A_5$. This assumes that the initial line tension was zero. Detail B of FIG. 5 shows the stress-strain curve for a pre-tensioned or "Tuned" cable. Note that for the same amount of strain ($\Delta L$) the amount of energy absorbed has tripled. This means that a "Tuned" cable does not need to stretch or strain as far as a non-tuned cable to absorb the same amount of energy because tuning the cable forces it to absorb energy at a higher rate.

Tuning cable provides several important benefits for horizontal lifeline systems. First, the initial pre-tension reverses the fall acceleration vector sooner in the fall cycle, thus reducing total fall distance, input energy, and the momentum, or mass times velocity, achieved by the falling object. If you don't allow energy to enter at the beginning of a fall cycle you don't have to absorb it at the end by additional tension and strain. Second, by forcing the cable to absorb energy at a higher rate, not as much strain is required to reach equilibrium. Therefore by cable tuning, the user has achieved the best of both worlds. He has reduced total fall distance and line tension and done so both at the same time.

Most HLL systems require 150 to 300-lb. of pre-tension to suspend the cable at the proper sag angles. Cable tuning requires much higher tensions, typically in the 1000 to 2000-lb. range. The cost to the system of cable tuning is that one gives up or reduces total energy capacity to achieve lower line tension and strain. But in terms of total energy capacity a reduction of merely 1% can make significant reductions in HLL tension and total fall distance.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A method for creating a horizontal lifeline between a pair of end anchorages, the horizontal lifeline arresting a fall of a worker of a weight, the method comprising:

providing a section of line having a modulus of elasticity;

providing an energy absorbing shock absorber having a deployment load;

connecting the section of line and the shock absorber to one another, between the end anchorages and tightening the section of line to achieve a sag angle $\alpha$, wherein $\alpha$ is between about 2 degrees and about 3.5 degrees; and tuning the section of line by pre-tensioning the section of line and selecting the shock absorber deployment load to where the deployment load is approximately equal to one half the weight of the worker divided by the sine of $\alpha$, and so that the pre-tension in the line is approximately equal to the deployment load.

* * * * *